US006497463B2

(12) United States Patent
Moretti

(10) Patent No.: US 6,497,463 B2
(45) Date of Patent: Dec. 24, 2002

(54) FRONT COVER FOR AIR CONDITIONER

(75) Inventor: Stephen L. Moretti, Auburn, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/859,041

(22) Filed: May 16, 2001

(65) Prior Publication Data

US 2002/0171337 A1 Nov. 21, 2002

(51) Int. Cl.[7] ..... F25D 23/12
(52) U.S. Cl. ..... 312/236; 312/265.5; 62/262
(58) Field of Search ..... 312/101, 100, 312/213, 257.1, 263, 265.5, 236, 327, 328; 62/262, 263, 297, 298; 454/201; 16/225, DIG. 13; 220/836

(56) References Cited

U.S. PATENT DOCUMENTS 3,663,990 A * 5/1972 Shane ..... 16/269
3,766,749 A * 10/1973 Livesay ..... 62/262
4,555,983 A 12/1985 Bolton et al.
4,607,500 A * 8/1986 Bolton et al. ..... 312/101
5,193,355 A * 3/1993 Matsumi ..... 312/101
5,203,400 A * 4/1993 Tsunekawa et al. ..... 165/122
5,315,842 A * 5/1994 Bolton et al. ..... 62/262
5,621,387 A * 4/1997 Phillips et al. ..... 174/52.1
6,394,563 B2 * 5/2002 Sugamura ..... 312/257.1

* cited by examiner

*Primary Examiner*—Janet M. Wilkens
(74) *Attorney, Agent, or Firm*—Wall Marjama & Bilinski LLP

(57) ABSTRACT

Apparatus for removably supporting a front cover upon an air conditioning unit. The cover includes a top wall and a bottom wall that are separated by a given distance at the rear opening of the cover. The top wall includes a hanger for rotatably mounting the top wall of the cover at the rear opening upon the top edge of a support member mounted upon the unit. A horizontally disposed rib is mounted upon the base pan of the unit beneath the top edge of the support member and the bottom surface of the rib is located a given distance from the top edge of the support member that is substantially equal to the given distance between the top and bottom walls of the cover at the rear opening so that the cover can be secured over the support member and rib when it is brought to a closed position. A stop is provided to locate the cover in the closed position and magnets are employed to latch the cover in the closed position.

6 Claims, 4 Drawing Sheets

FRONT COVER FOR AIR CONDITIONER

BACKGROUND OF THE INVENTION

This invention relates to an air conditioning unit and, in particular, to a removable front cover for an air conditioning unit.

This invention more specifically related to a removable front cover for a package terminal air conditioning (PTAC) unit. Typically, this type of unit is housed within a rectangular shaped sleeve that is mounted within an outside wall of a building containing the room or comfort area being serviced by the air conditioning unit. The unit is generally separated into an outdoor section and an indoor section by a dividing wall. Each section contains a heat exchanger and a fan for moving air over the heat exchanger. The outdoor fan and a heat exchanger are housed within the sleeve and the indoor fan and heat exchanger are housed within a front cover that closes against the sleeve.

The front covers heretofore generally employed by PTAC units have been joined to the unit by threaded fasteners or snap-in fasteners. Threaded fasteners tend to get easily lost and are seldom replaced once they are lost. Snap-in fasteners, on the other hand, are generally weak and thus easily broken. Missing or broken fasteners cause the cover to become misaligned on the unit and allow unwanted access to the interior of the unit.

SUMMARY OF THE INVENTION

It is therefore an object of the present invention to improve air conditioning units and, in particular, packaged terminal air conditioner units.

It is a further object of the present invention to improve front covers used on packaged terminal air conditioner units.

A still further object of the present invention is to provide a front cover for an air conditioning unit that does not require threaded fasteners or snap-in fasteners to provide for secure closure of the cover.

Another object of the present invention is to provide a front cover for an air conditioning unit that can be easily installed upon the unit and securely latched in a closed position.

These and other objects of the present invention are attained by apparatus for removably securing the front cover of an air conditioning unit in a tightly closed condition. The cover includes a top wall and a bottom wall that are separated by a given distance as measured over the rear opening of the cover. The top wall of the cover is equipped with a series of hangers located along its outer edge for rotatably mounting the cover upon a support member that is part of the dividing wall that separates the indoor and outdoor sections of the unit. The bottom wall of the cover is arranged to close snugly over a rib mounted upon the base pan of the unit. Magnetic stops are used to latch the cover against the base pan when the cover is brought to a closed position.

BRIEF DESCRIPTION OF THE DRAWINGS

For a better understanding of these and other objects of the invention, reference will be made to the following detailed description of the invention which is to be read in association with the following drawings, wherein.

DETAILED DESCRIPTION OF THE INVENTION

Figure 1:
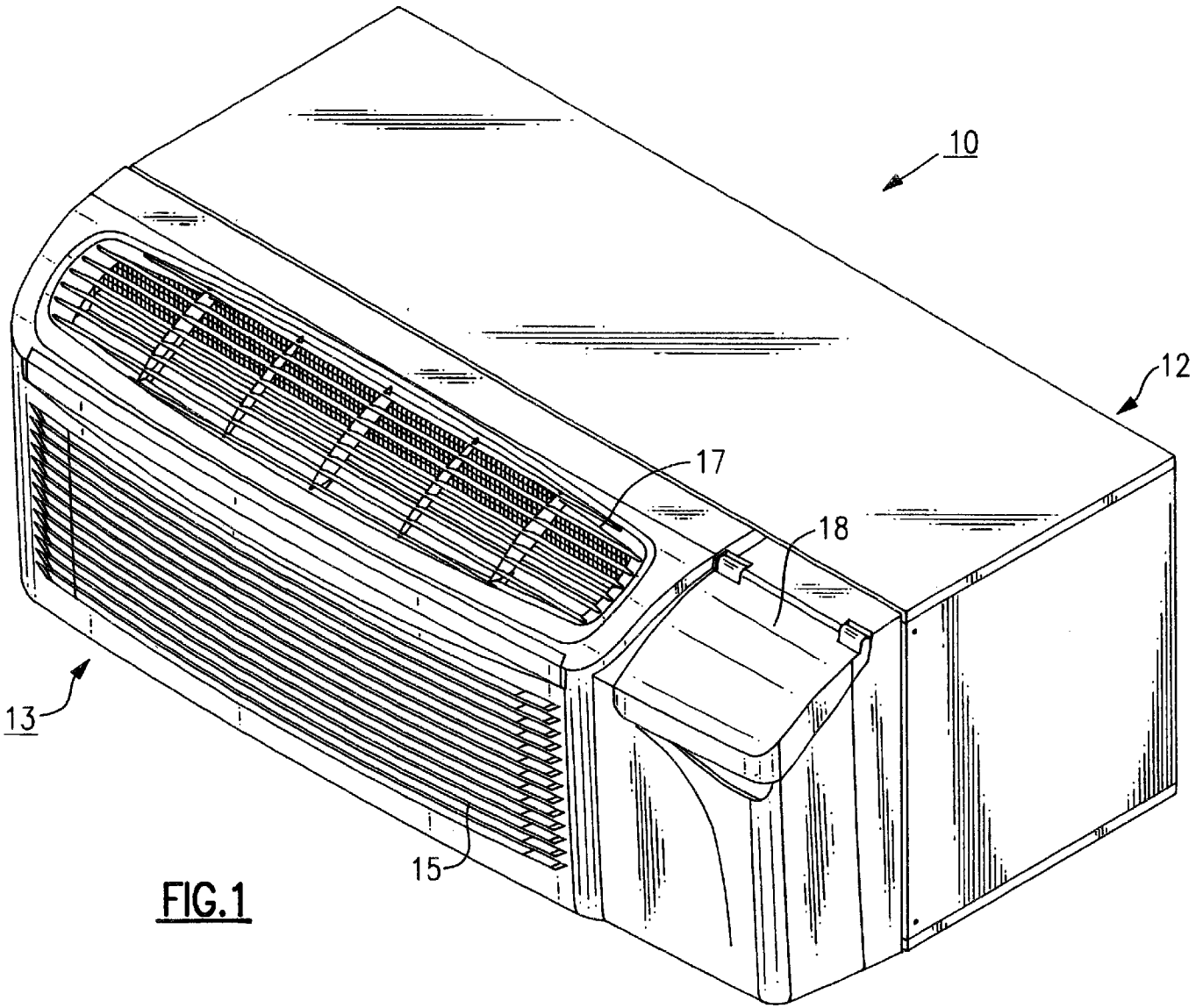
FIG. 1 is a front perspective view of a packaged terminal air conditioning unit embodying the teachings of the present invention.

Turning initially to FIG. 1, there is illustrated a packaged terminal air conditioning unit, generally referenced 10, embodying the present invention. The unit includes a rectangular shaped sleeve 12 that houses the outdoor section of the unit and a front cover 13 that houses the indoor section of the unit. The cover contains an air inlet opening 15 through which supply air is drawn into the unit from the room or comfort area being serviced by the unit. An air outlet opening 17 is also contained in the cover through which conditioned air is returned to the comfort area. The unit controls are mounted in the indoor section of the unit beneath a hinged access door 18 mounted in the front cover. As will be described in further detail, the front cover is arranged to close tightly against the sleeve to enclose the indoor section of the unit.

Figure 2:
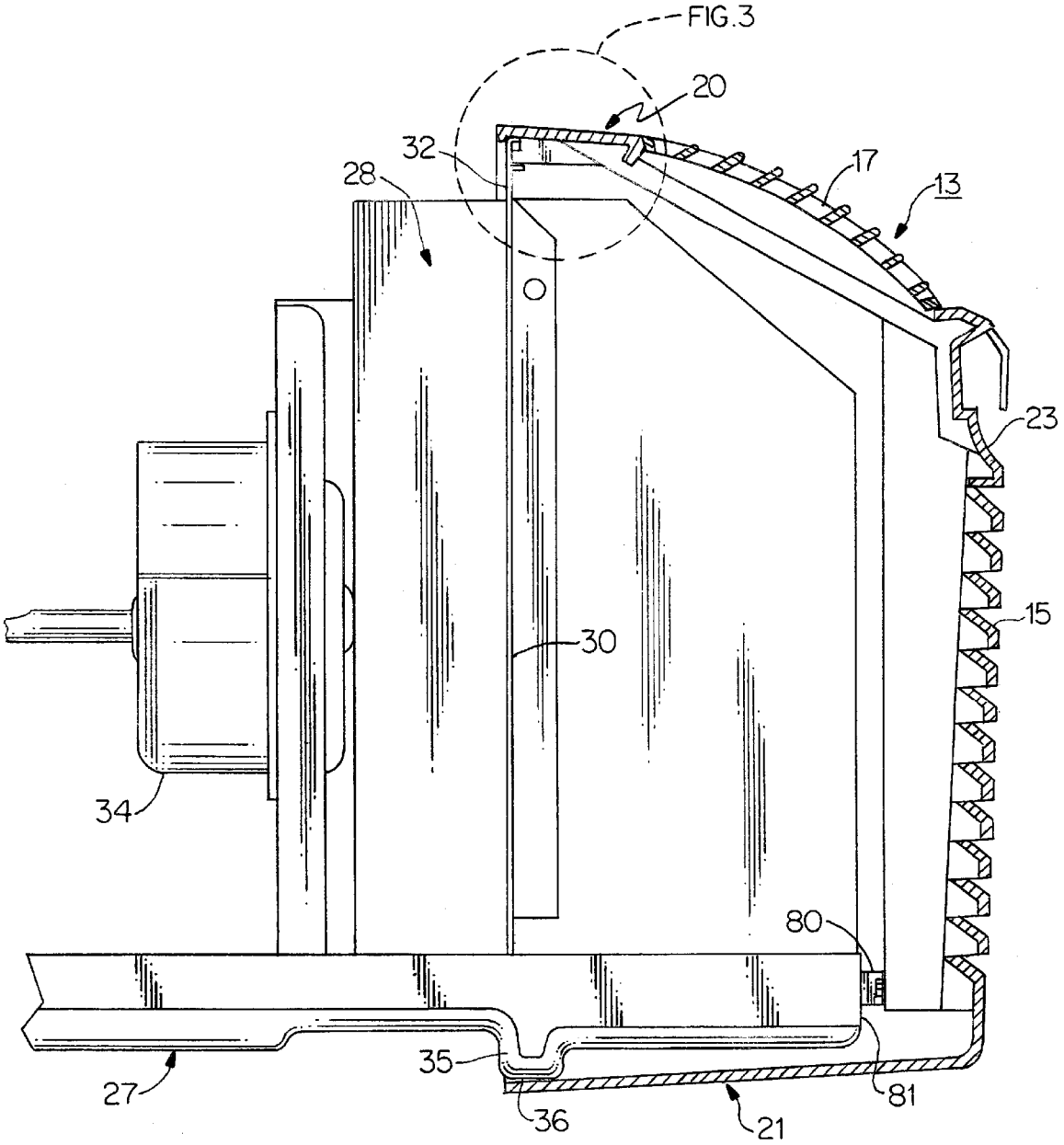
FIG. 2 is an enlarged partial side view in section of the air conditioning unit showing the front cover in further detail.

Turning now to FIGS. 2–6, the front cover includes a top wall 20 containing the outlet opening 17 and an opposed bottom wall 21. The top and bottom walls are cojoined by a front wall 23 that contains the air inlet opening 15 and a pair of side walls 24 and 25 complete the cover (See FIG. 5). The cover is molded from a suitable plastic material and contains a rear opening so that the cover can be placed over the indoor section of the unit and move into closure against the sleeve 12. As best illustrated in FIG. 2, the unit includes a base pan 27 upon which the various unit components are mounted. The unit is separated into an indoor section and an outdoor section by a dividing wall 28. A vertically disposed support member 30 forms part of the dividing wall and has an upwardly extended top section 32 that is raised above the main body of the dividing wall. The top edge of the support member extends horizontally across the width of the unit. A single motor 34 is supported in the dividing wall for driving both the indoor fan and the outdoor fan of the unit. The outdoor fan has been removed from the motor in FIG. 2 for the sake of clarity.

The base pan of the unit contains a downwardly depending rib 35 having a flat horizontally disposed bottom surface 36. The rib is positioned directly beneath the support member 30. The top and bottom walls of the cover are arranged to pass over the top edge of the support member and the bottom surface of the rib at closing as illustrated in FIG. 2. The vertical distance between the top and bottom walls at the rear opening of the cover is substantially equal to or slightly less than the vertical distance between the top edge of the support wall and the bottom surface of the rib. As will be explained in greater detail below, hangers are mounted along the outer edge of the top wall of the cover at the rear opening that enables the cover to be rotatably mounted upon the top edge of support member 30. The bottom wall of the cover is brought over the rib at closure. The cover is formed of a resilient plastic material and thus has the ability to flex or deform slightly. The top wall and the bottom wall of the cover converge slightly from the rear opening toward the front wall of the cover so that the cover fits tightly as it moves back over the rib so that when the cover is fully closed against the sleeve, the cover is securely held in the closed position.

Figure 3:
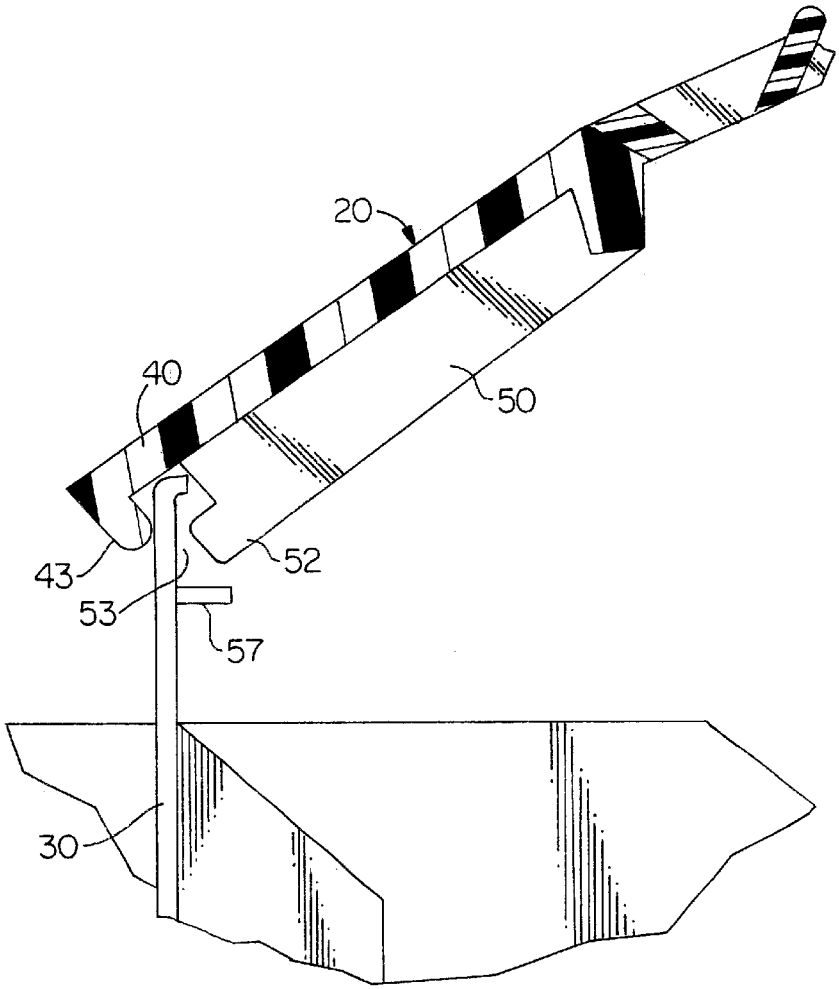
FIG. 3 is a further enlarged partial side view of the top wall of the cover near the cover's rear opening showing the top wall of the cover engaging a support member at an angle.
Figure 6:
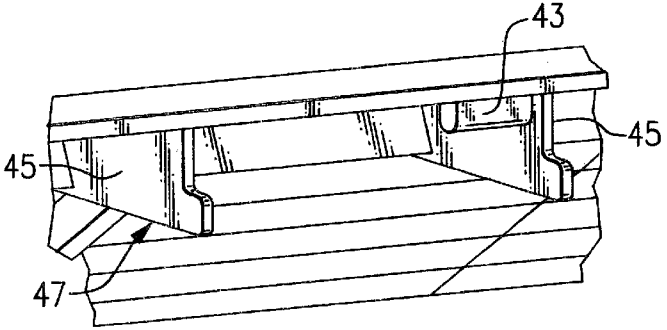
FIG. 6 is a further enlarged view, in perspective, illustrating one of the hanger units employed in the practice of the invention.

Turning more specifically to FIGS. 3 and 6, there is shown the distal end 40 of the top wall of the cover. A series of inwardly directed tabs 43 depend from the outer edge of the top wall. A pair of L-shaped brackets 45 are mounted on the inside surface of the top wall on either side of some of the tabs as illustrated in FIG. 6 to establish what will be herein referred to as a hanger unit generally referenced 47. Three such units are shown mounted along the outer edge of the top wall and, as will be explained below, permit the cover to be hung upon the top edge of the support member 30.

Each L-shaped bracket includes a first elongated leg 50 that is secured to the inside of the top wall of the cover and extends inwardly from the wall generally perpendicular to the wall. A second leg 52 extends from the bottom of each bracket generally parallel to the top wall towards the open end of the cover. A space 53 is provided between the distal end of the second leg of the bracket and the associated tab 43 through which the top of the support member 30 can pass when the cover is canted upwardly as illustrated in FIG. 3. The top edge of the support member is equipped with a short horizontally disposed flange 55 which, as shown in FIG. 3, is brought into contact against the inside surface of the top wall of the cover. The flange provides a surface about which the cover can easily turn.

Figure 4:
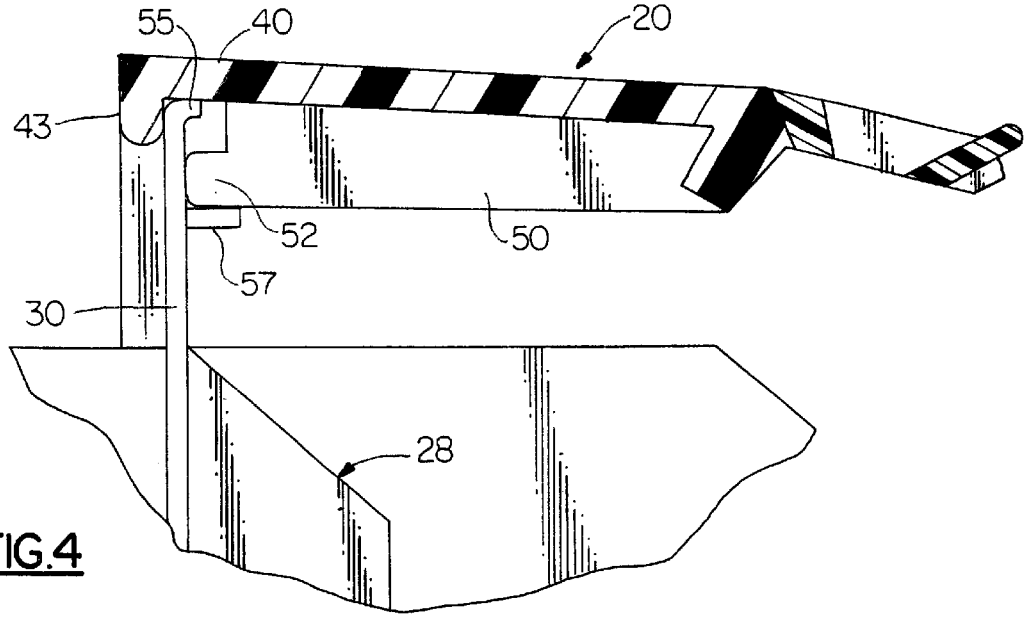
FIG. 4 is a side view similar to FIG. 3 showing the cover rotated down into a closed position.

A series of flat horizontally disposed seats 57 are secured to the top section of the support member. The top surface of each seat is located a given distance from the top edge of the support member that is substantially equal to the distance between the inside of the top wall and the bottom surface of the second leg of each bracket at the cover opening. Accordingly, when the cover is rotated from the initial loading position illustrated in FIG. 3 to a closed position as illustrated in FIG. 4, the bottom surface of each bracket is brought into seating contact against the seats and the tabs located between the brackets are brought into parallel alignment against the backside of the support member. As noted above, at closure the bottom wall of the cover is brought over the bottom surface of the rib 35 that depends from the underside of the unit base pan to secure the cover to the unit.

Figure 5:
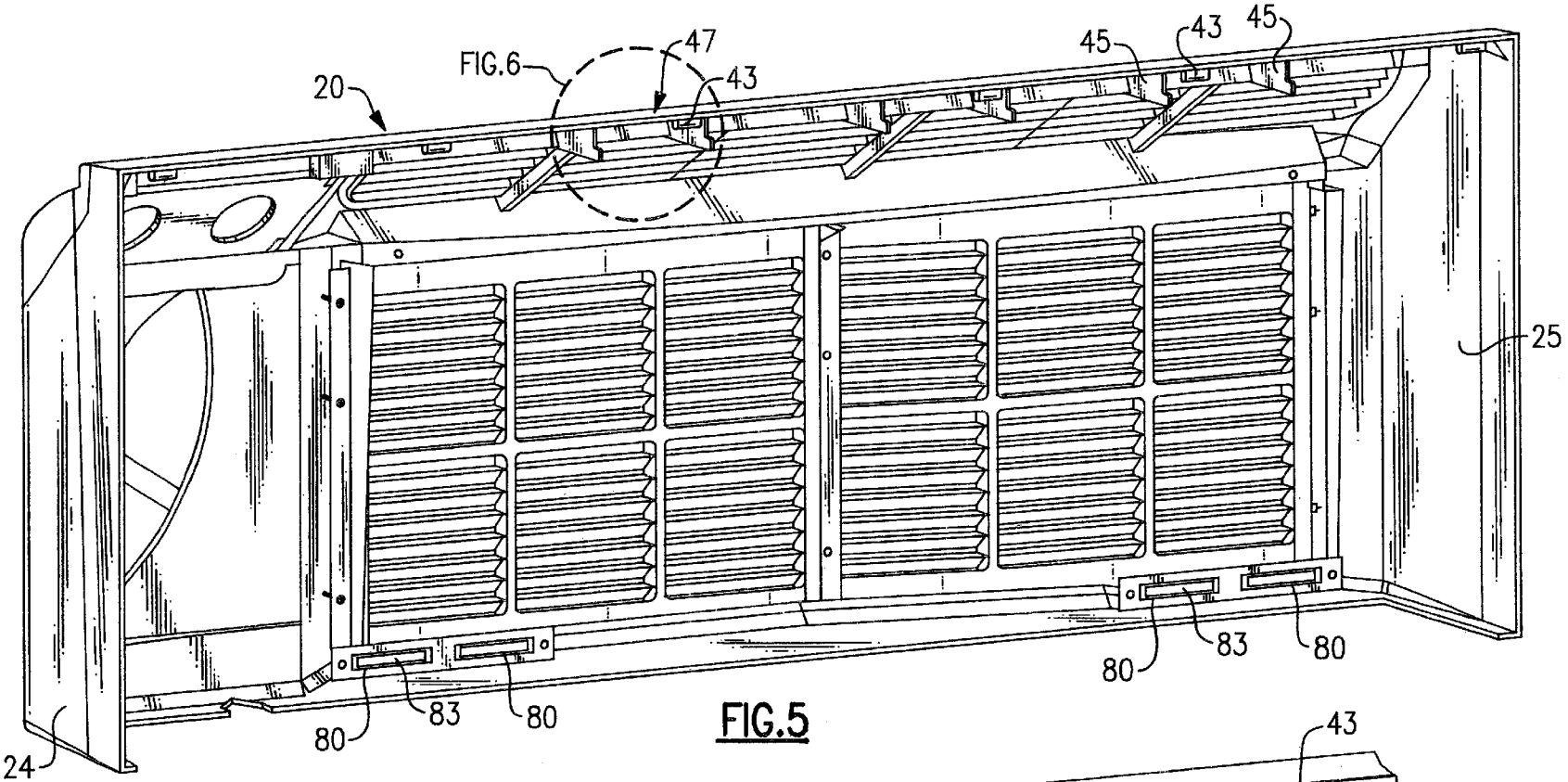
FIG. 5 is an enlarged rear perspective view of the front cover looking into the cover through the rear and opening.

As illustrated in FIGS. 2 and 5, stops 80-80 are mounted on the lower inside part of the cover's front wall which, at closure, rest in contact against the vertical front wall 81 of the base pan. The base pan is fabricated from a permeable material and each stop houses a magnet 83 that magnetically latches the cover to the base pan. When in the closed and latched position, as illustrated in FIG. 2, the back edges of the cover at the rear opening are flush with the sleeve and the front wall 23 of the cover is held in a vertical position as illustrated in FIG. 1.

While this invention has been explained with reference to the structure disclosed herein, it is not confined to the details set forth and this invention is intended to cover any modifications and changes as may come within the scope of the following claims:

What is claimed is:

1. Apparatus for removably connecting a front cover to an air conditioning unit that includes:

a front cover having top and bottom walls that are joined by a front wall and two side walls so that the back of the cover is open, the inside surfaces of the top and bottom walls at the rear opening being spaced apart at a first distance; a support member located on the top side of an air conditioning unit having a horizontally disposed top edge and a series of horizontally disposed seats secured to said support member that extend toward the front of said unit, the top surfaces of said seats lying in a common plane that is located a second distance from said top edge of said support member, a horizontally extended rib secured to the underside of said unit that is located beneath the top edge of said support member and having a bottom surface that is spaced apart from said top edge of said support member a vertical distance that is substantially equal to said first distance;

a series of L-shaped brackets, each having a first leg secured to the inner surface of said top wall and a second leg that extends back toward the rear opening of said cover, said second leg having a bottom surface that is spaced from the inside surface of the top wall a distance that is substantially equal to said second distance, and a series of inwardly directed tabs located along the outer edge of said top wall of the cover at said rear opening thereof so that the top edge of said support member can pass inside said cover behind said tabs into contact with the inner surface of said top wall whereby bringing the bottom wall of the cover over the bottom surface of said rib secures the cover to the unit.

2. The apparatus of claim 1 wherein said tabs are centered between two spaced apart brackets.

3. The apparatus of claim 1 that further includes a flange located along the top edge of said support member about which the cover rotates.

4. The apparatus of claim 1 that further includes a stop means for limiting the amount of rotation afforded the cover about the support member in a closed position over the front of the unit.

5. The apparatus of claim 4 wherein said stop means further includes latching means for holding the cover in said closed position.

6. The apparatus of claim 5 wherein said latching means includes a series of magnets mounted upon the cover that are arranged to close magnetically against said unit.

* * * * *